US010119277B1

(12) United States Patent
Tscherkaschin

(10) Patent No.: US 10,119,277 B1
(45) Date of Patent: Nov. 6, 2018

(54) KIT FOR MOUNTING A FIXTURE AT A SURFACE USING A FASTENER TO SECURE THE KIT IN A MOUNTING POSITION

(71) Applicant: Nikolai Tscherkaschin, Mitchell (CA)

(72) Inventor: Nikolai Tscherkaschin, Mitchell (CA)

( * ) Notice: Subject to any disclaimer, the term of this patent is extended or adjusted under 35 U.S.C. 154(b) by 0 days.

(21) Appl. No.: 15/792,174

(22) Filed: Oct. 24, 2017

(51) Int. Cl.

| | |
|---|---|
| ***F16M 13/00*** | (2006.01) |
| ***E04F 11/18*** | (2006.01) |
| ***A47K 17/02*** | (2006.01) |
| ***A47B 96/06*** | (2006.01) |
| ***A47B 97/00*** | (2006.01) |

(52) U.S. Cl.
CPC ..... *E04F 11/1804* (2013.01); *A47B 96/068* (2013.01); *A47B 97/001* (2013.01); *A47K 17/022* (2013.01)

(58) Field of Classification Search
USPC ..... 248/231.91
See application file for complete search history.

(56) References Cited

U.S. PATENT DOCUMENTS 1,469,304 A * 10/1923 Hughes ..... F16D 1/05 403/305
4,102,529 A * 7/1978 Neblung ..... E04F 11/181 248/251
4,647,241 A * 3/1987 Weber ..... F16B 7/0426 403/18
4,691,818 A * 9/1987 Weber ..... B65G 33/32 198/666
5,690,237 A * 11/1997 Marzec ..... A47K 3/003 211/105.1
6,095,713 A * 8/2000 Doyle ..... A01G 9/1407 403/97
7,124,451 B2 * 10/2006 Moore ..... A47K 3/003 4/576.1
8,172,477 B2 * 5/2012 Damsi ..... B60J 7/062 403/205
8,382,051 B2 * 2/2013 Smith ..... A47K 10/10 211/105.1
8,533,912 B2 * 9/2013 Tran ..... A47B 95/02 16/110.1
8,998,175 B2 * 4/2015 Graber ..... E04F 11/1836 256/65.02
9,670,950 B2 * 6/2017 Anderson ..... F16B 35/005
9,765,527 B2 * 9/2017 Hart ..... E04F 11/1808
9,783,990 B2 * 10/2017 Walker ..... E04F 11/1808
(Continued)

*Primary Examiner* — Monica E Millner
(74) *Attorney, Agent, or Firm* — Kyle R. Satterthwaite; Ade & Company Inc.; Ryan W. Dupuis

(57) ABSTRACT

A kit for mounting a fixture at a surface comprises first and second brackets for attaching to the fixture and for fixedly locating at the surface. The second bracket defines a cavity for receiving the first bracket in a mounting position of the kit, and the two brackets are connectable by a fastener passed through the pair of brackets arranged in the mounting position. The first bracket features a passageway opening at opposite sides of the bracket, and the second bracket features a fastener aperture and opposite thereto a tip receptacle for receiving a leading tip of the fastener, such that the second bracket is engaged by the fastener at more than one location to maintain the kit in the mounting position. The first and second brackets also feature a cooperating groove and ridge in the interior of the cavity, which are mated in the mounting position.

10 Claims, 11 Drawing Sheets

(56) References Cited

U.S. PATENT DOCUMENTS

| | | | | |
|---|---|---|---|---|
| 9,863,114 | B2 * | 1/2018 | Kaufman | E02D 5/526 |
| 2002/0134976 | A1 * | 9/2002 | Swartz | A47K 17/022 256/59 |
| 2010/0252792 | A1 * | 10/2010 | Bennett | A47K 17/022 256/21 |

* cited by examiner

KIT FOR MOUNTING A FIXTURE AT A SURFACE USING A FASTENER TO SECURE THE KIT IN A MOUNTING POSITION

FIELD OF THE INVENTION

The present invention relates to mounting hardware for mounting a fixture, for example a handrail, at a surface, such as that defined by a wall, and more particularly to such mounting hardware employing a fastener to secure the kit in a mounting position, often called a set screw in industry.

BACKGROUND

A "set screw" as it is referred to in industry is a fastener used to secure an object within or against another object without using a nut. Most commercially available mounting hardware kits designed for use with a set screw comprise a single aperture in an outer bracket through which the set screw is passed into a passageway in an inner bracket which is received in the outer bracket. Thus, it is at this single location where there is an interface between the first and second brackets, or connectors, where the aperture in the outer bracket is communicated with where the passageway opens in the inner bracket, that the two brackets are maintained in fixed relation to one another by the fastener passed therethrough.

SUMMARY OF THE INVENTION

According to an aspect of the invention there is provided a kit for mounting a fixture at a surface, comprising:

a first bracket and a second bracket for attaching to the fixture and for fixedly locating at the surface;

the second bracket defining a cavity for receiving the first bracket in a mounting position of the kit, the second bracket having a mouth aperture in an end of the second bracket communicating the cavity with an exterior of the second bracket in a longitudinal direction of the second bracket through which the first bracket can be passed for arranging the kit in the mounting position;

a fastener aperture in the second bracket communicating the cavity with the exterior of the second bracket in a transverse direction of the second bracket for passing a fastener from a location exterior to the second bracket into the cavity in the transverse direction;

the second bracket including a stop surface in the vicinity of the fastener aperture for abutting a head of the fastener received through the fastener aperture so as to prevent passage of the head into the cavity;

a passageway in the first bracket opening at opposite sides of the first bracket that is alignable with the fastener aperture in the mounting position of the kit to receive the fastener after the fastener is passed through the fastener aperture in the second bracket;

and a fastener tip receptacle in the second bracket that is alignable with the passageway in the first bracket and opening into the cavity so as to be communicated therewith and to receive a leading tip of the fastener that is passed through the passageway such that in the mounting position the fastener engages the second bracket at more than one location on the second bracket including at the stop surface and at the fastener tip receptacle.

In this arrangement, the fastener engages the second bracket at more than one spaced locations on the second bracket so as to resist movement of the kit out of the mounting position and thus maintain the first bracket in fixed relation to the second bracket.

In one arrangement, the first bracket includes a longitudinally extending groove and the second bracket includes a ridge extending in the longitudinal direction and protruding into the cavity for mating with the groove.

According to another aspect of the invention there is provided a kit for mounting a fixture at a surface, comprising:

a first bracket and a second bracket for attaching to the fixture and for fixedly locating at the surface;

the second bracket defining a cavity for receiving the first bracket in a mounting position of the kit, the second bracket having a mouth aperture in an end of the second bracket communicating the cavity with an exterior of the second bracket in a longitudinal direction of the second bracket and through which the first bracket can be passed for arranging the kit in the mounting position;

a fastener aperture in the second bracket communicating the cavity with the exterior of the second bracket in a transverse direction of the second bracket for passing a fastener from a location exterior to the second bracket into the cavity in the transverse direction;

a passageway in the first bracket that is alignable with the fastener aperture for receiving the fastener, in the mounting position of the kit, after the fastener is passed through the fastener aperture in the second bracket;

the first bracket including a longitudinally extending groove and the second bracket including a ridge extending in the longitudinal direction and protruding into the cavity for mating with the groove so as to resist rotation of the first bracket relative to the second bracket about the longitudinal direction.

Typically, the fastener tip receptacle is formed in the ridge and the passageway in the first bracket opens at the groove.

Preferably, the fastener aperture decreases in diameter from an outside of the bracket towards the cavity such that the stop surface is defined by a wall defining the fastener aperture.

Preferably, the fastener tip receptacle is conical in shape.

Preferably, the fastener tip receptacle is not linearly aligned with the fastener aperture so that a wall of the tip receptacle acts to bias the fastener in a direction in which the tip receptacle is offset from the fastener aperture.

Preferably, the fastener tip receptacle is offset in the longitudinal direction of the second bracket away from the mouth aperture.

Thus, the biasing provided by the offset tip receptacle provides another interaction in such an arrangement for maintaining the kit in the mounting position.

Preferably, the wall of the tip receptacle has a prescribed hardness so as to not be pierced by the fastener or, in other words, be impenetrable thereto. That is, the fastener cannot be embedded in the wall of the tip receptacle.

For example, the second bracket is made of stainless steel.

Preferably, a wall of the passageway in the first bracket has a prescribed softness so as to be penetrable or piercable by the fastener.

In such an arrangement, upon tightening of the fastener, which typically is threaded, the first bracket is drawn towards the second bracket at the fastener aperture providing another interaction by which the first bracket is maintained in fixed relation to the second bracket.

For example, the first bracket is made of resilient plastic which can accept threads of a fastener embedded therein without shattering.

Preferably, the first bracket is arranged so that the passageway is misaligned with the fastener aperture in the mounting position of the kit.

BRIEF DESCRIPTION OF THE DRAWINGS

The invention will now be described in conjunction with the accompanying drawings in which.

In the drawings, like characters of reference indicate corresponding parts in the different figures.

DETAILED DESCRIPTION

Figure 1:
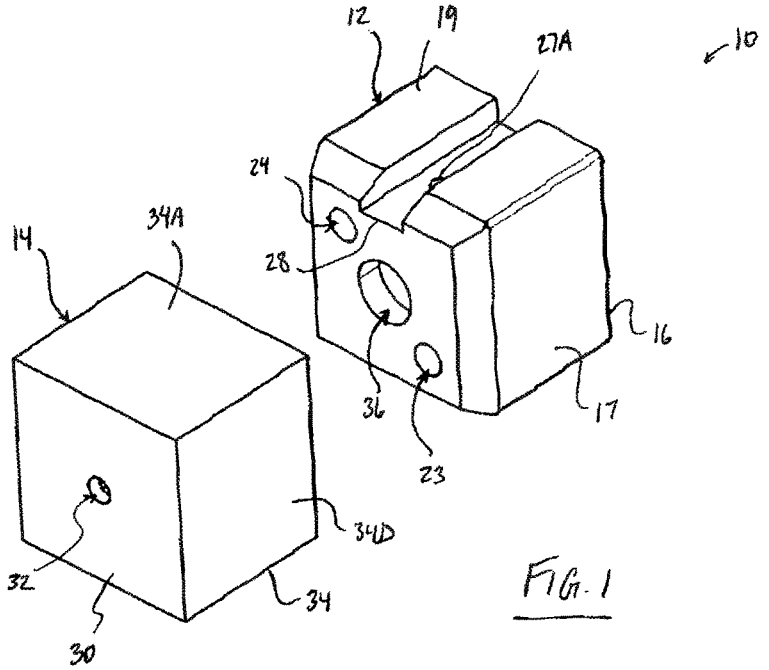
FIG. 1 is a first exploded view of an arrangement of kit comprising first and second brackets for mounting a fixture at a surface according to the present invention, where the kit is shown in perspective.
Figure 2:
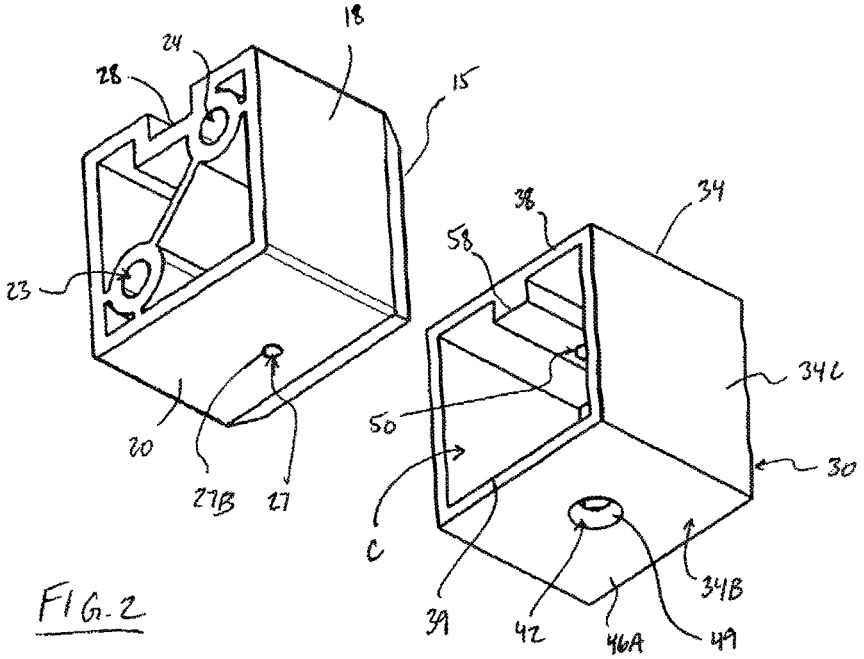
FIG. 2 is a second exploded view of the arrangement of FIG. 1 shown in perspective.
Figure 3:
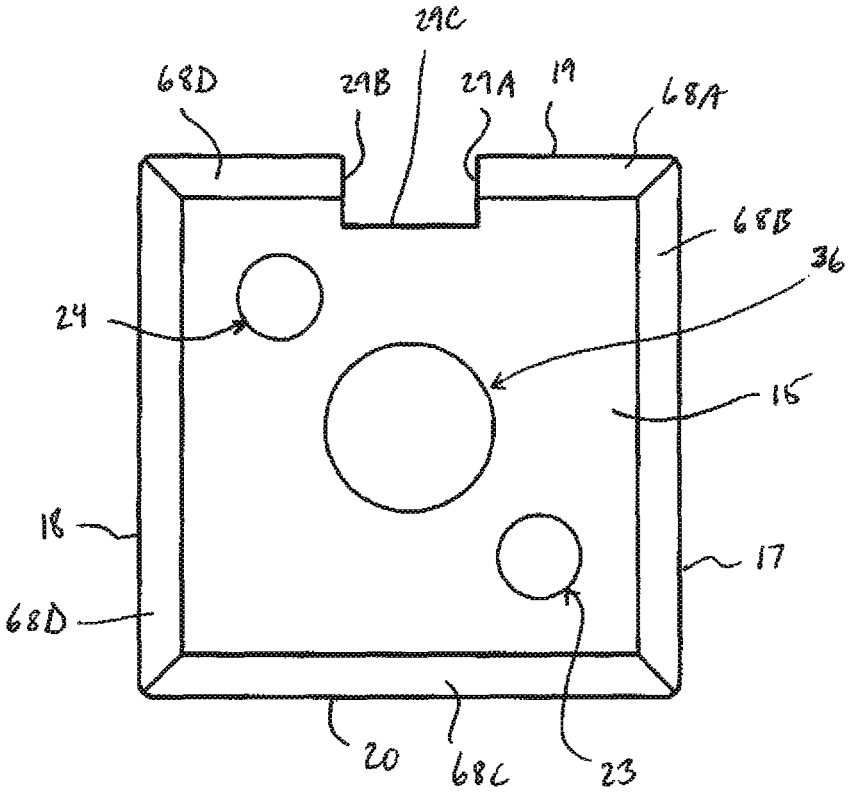
FIG. 3 is a front end elevational view of the first bracket of the arrangement of FIG. 1.
Figure 4:
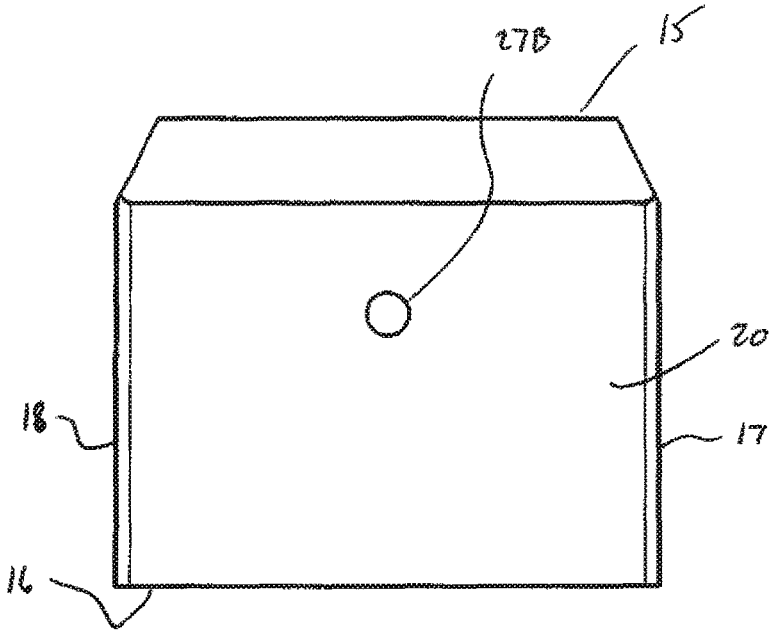
FIG. 4 is a bottom plan view of the first bracket of the arrangement of FIG. 1.
Figure 5:
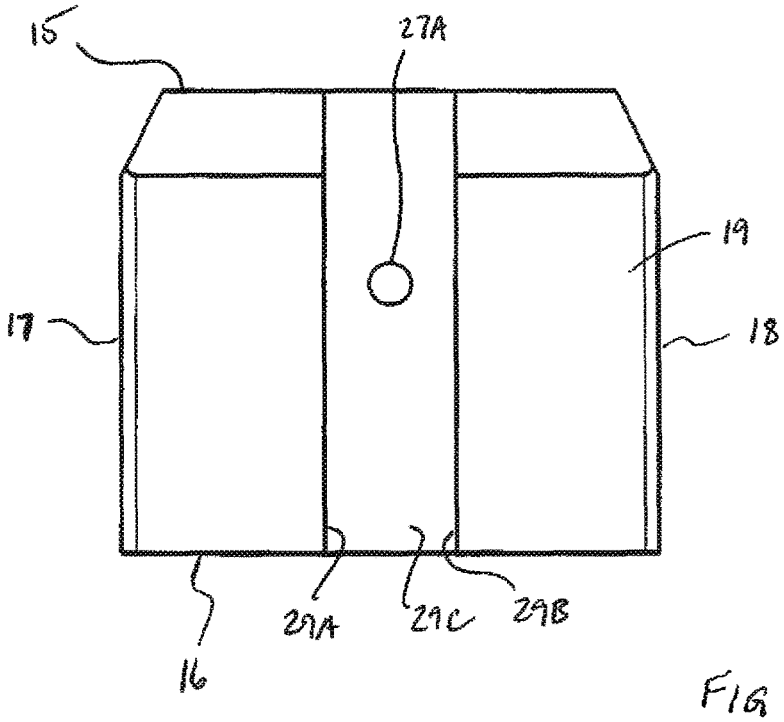
FIG. 5 is a top plan view of the first bracket of the arrangement of FIG. 1.
Figure 6:
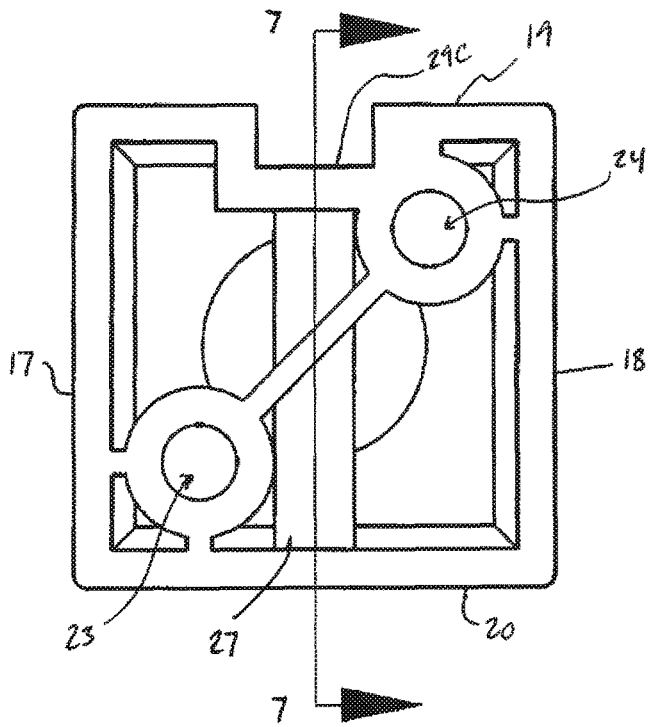
FIG. 6 is a rear end elevational view of the first bracket of the arrangement of FIG. 1.
Figure 7:
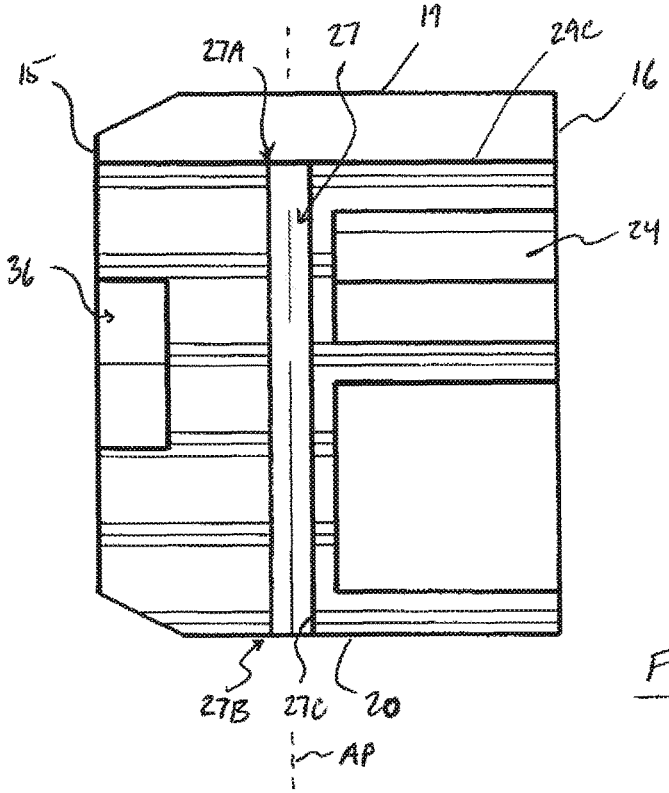
FIG. 7 is a cross-sectional view along line 7-7 in FIG. 6.
Figure 8:
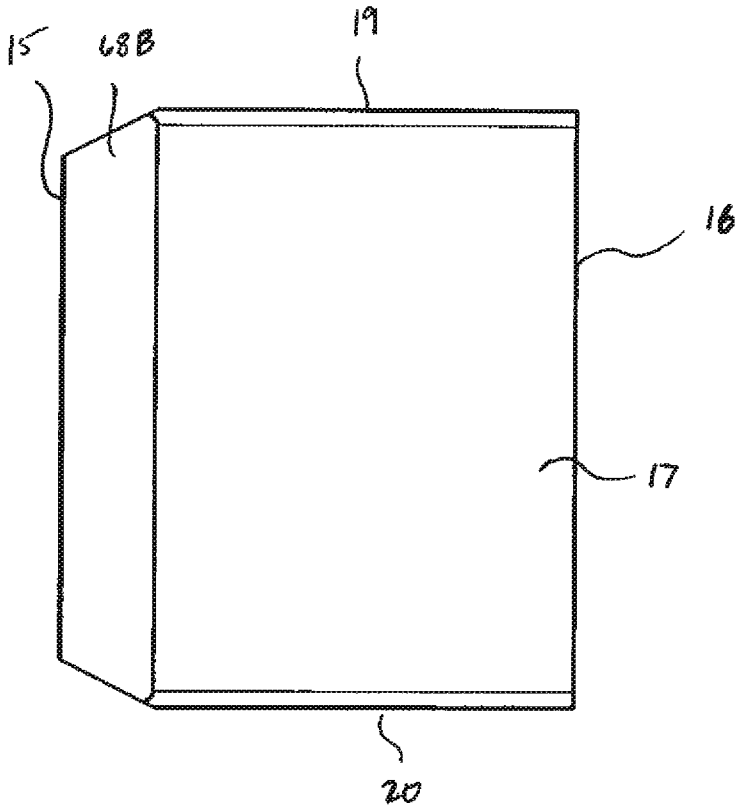
FIG. 8 is a side elevational view of the first bracket of the arrangement of FIG. 1.
Figure 9:
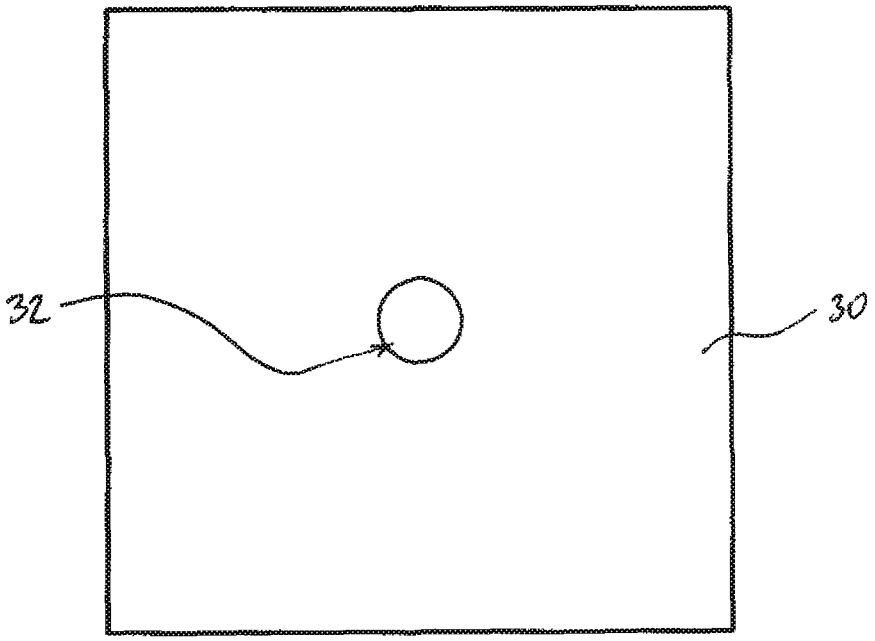
FIG. 9 is a front elevational view of the second bracket of the arrangement of FIG. 1.
Figure 10:
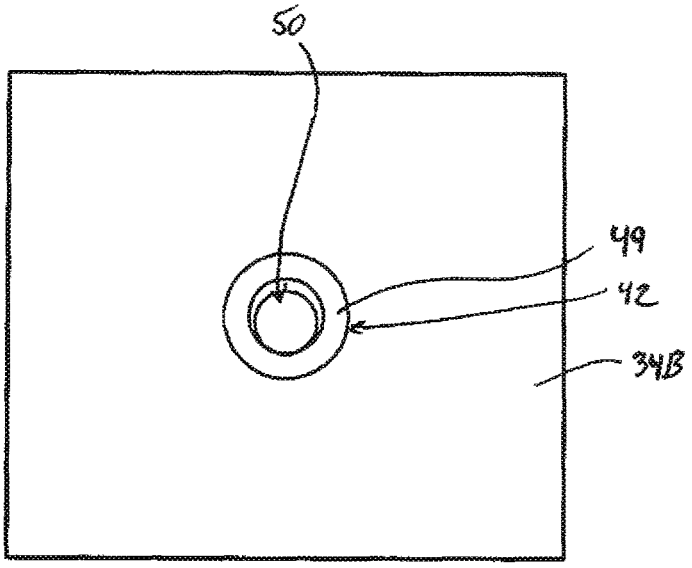
FIG. 10 is a bottom plan view of the second bracket of the arrangement of FIG. 1.
Figure 11:
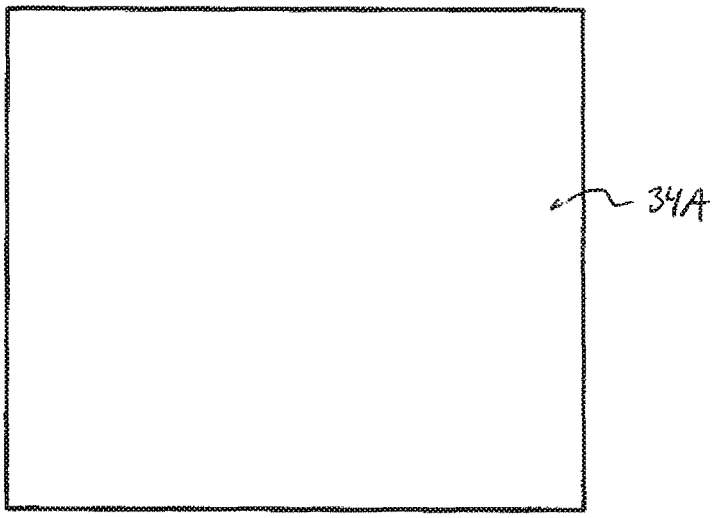
FIG. 11 is a top plan view of the second bracket of the arrangement of FIG. 1.
Figure 12:
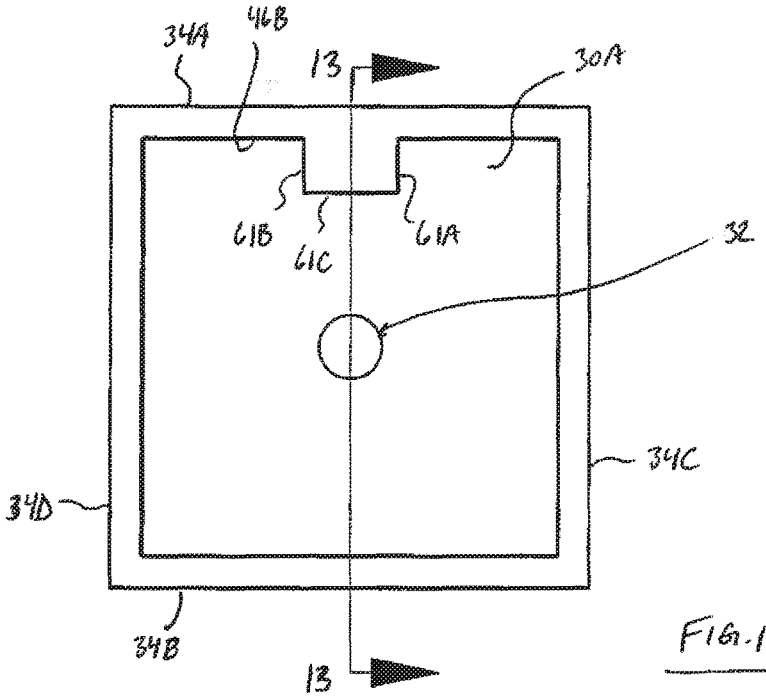
FIG. 12 is rear elevational view of the second bracket of the arrangement of FIG. 1.
Figure 13:
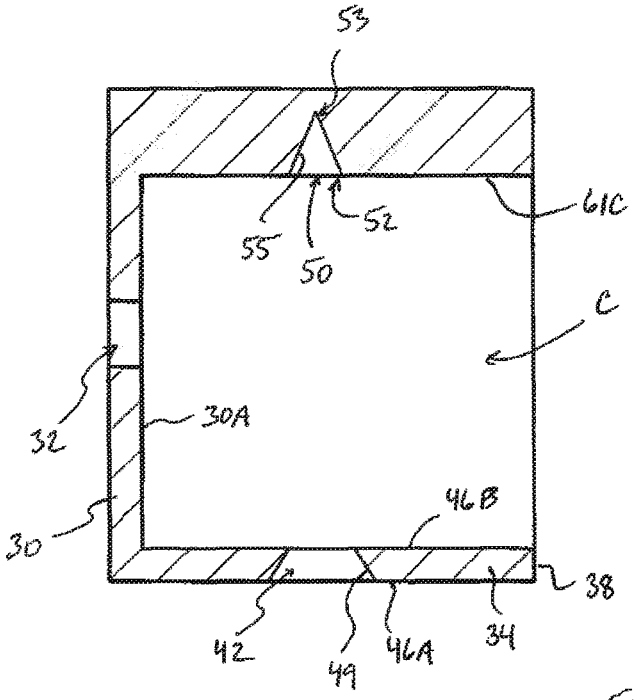
FIG. 13 is a cross-sectional along line 13-13 in FIG. 11.
Figure 14:
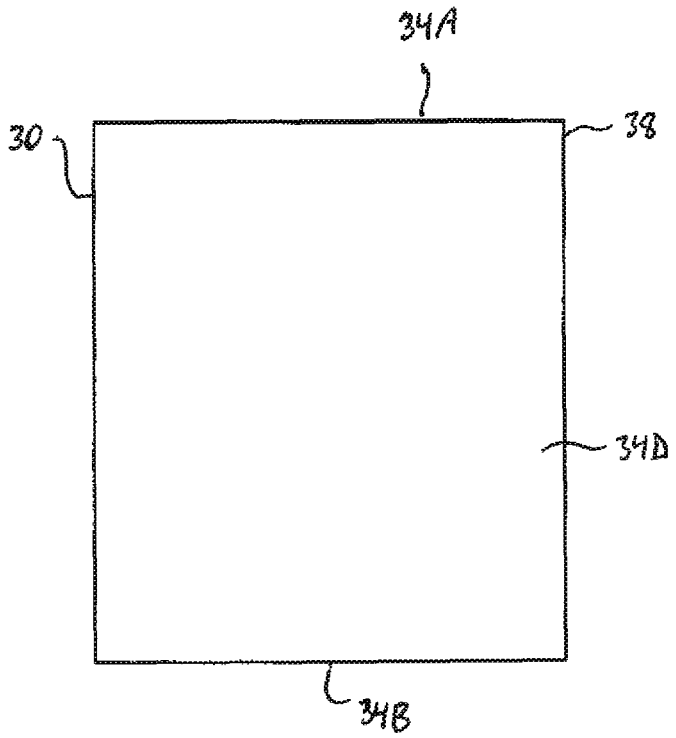
FIG. 14 is a side elevational view of the second bracket of the arrangement of FIG. 1.
Figure 15:
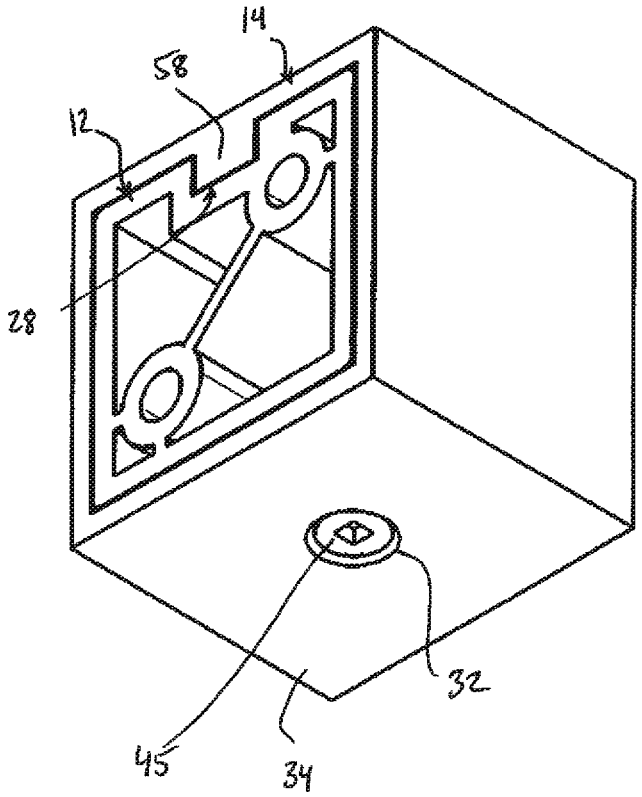
FIG. 15 is a perspective view of the arrangement of FIG. 1 shown in a mounting position of the kit, in which it is assembled.
Figure 16:
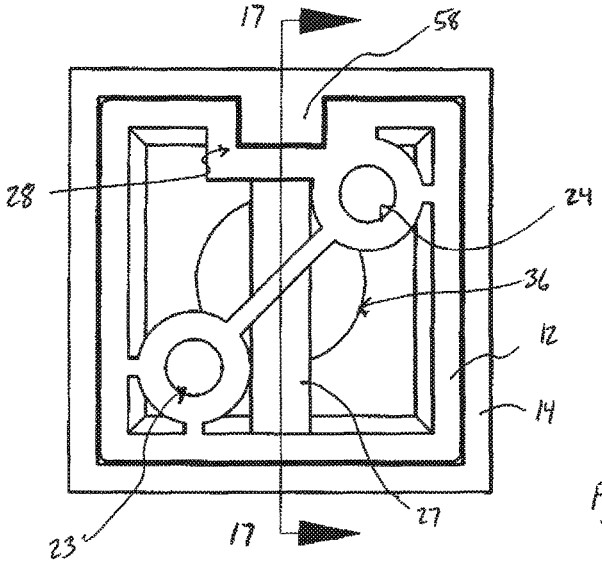
FIG. 16 is an elevational view from one end of the arrangement of FIG. 1 in the mounting position.
Figure 17:
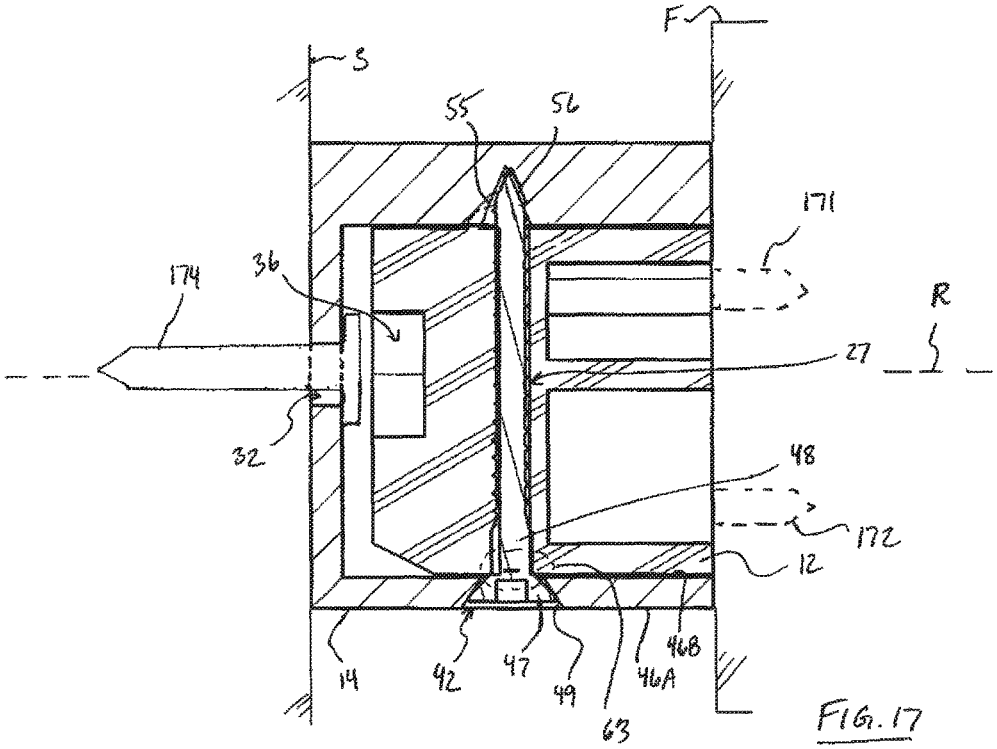
FIG. 17 is a cross-sectional view along line 17-17 in FIG. 14 also schematically showing a fixture and a surface.

The accompanying figures illustrate a kit 10 for mounting a fixture F (schematically shown), such as a handrail or panel, at a surface S (schematically shown), such as a vertically upright surface defined by a wall. The kit comprises a first inner bracket 12 and a second outer bracket 14 which receives the inner bracket 12 in a mounting position of the kit, shown in FIGS. 15-17, by which the fixture is mountable to the surface. Typically, the inner bracket 12 is attached to the fixture and the outer bracket 14 is located in fixed relation at the surface, for example by mounting to a structure supporting the surface (like a wooden frame supporting gypsum board, collectively forming the wall).

The first inner bracket 12, which is shown more clearly in FIGS. 1 to 8, comprises a bracket body forming a leading front end 15, a trailing rear end 16, and left and right sides 17, 18, a topside 19 and an underside 20 forming a square rectangular transverse periphery. As more clearly shown in FIG. 2 the bracket body has hollow interior portions, which open at the rear end 16, which reduces an amount of material used to manufacture the inner bracket.

A pair of mounting passageways 23, 24 extending in a longitudinal direction of the inner bracket are formed in the bracket body, opening at the front and rear ends 15, 16 for passing fasteners such as screws therethrough so as to attach the inner bracket 12 to the fixture with the rear end 16 in abutment with same.

The inner bracket includes a bracket interconnection passageway 27 formed in the bracket body and extending in a transverse direction of the inner bracket. The interconnection passageway follows a linear path and opens at apertures 27A and 27B at opposite sides 19 and 20 such that a fastener can be passed through a full height of the inner bracket.

The inner bracket 12 is made wholly from plastic such that a wall 27C of the interconnection passageway has a prescribed softness allowing a fastener, for example with its threads, to penetrate or pierce same. More specifically, the bracket 12 is made from a resilient plastic which can accept threads of a fastener embedded therein without shattering.

The interconnection passageway 27 is wholly spaced from either of the mounting passageways 23 and 24 and does not intersect same. The interconnection passageway is located centrally with respect to a width direction of the inner bracket (from left side 17 to right side 18), and the mounting passageways 23, 24 are located to either side of the interconnection passageway, in the width direction. Further, the mounting passageways are spaced from one another in both a height direction (from topside 19 to underside 20) and the width direction of the inner bracket. Each passageway receives a separate fastener.

Additionally, there is provided a groove 28 in the topside 19 of the inner bracket, extending in the longitudinal direction of the inner bracket along its full length so as to open at the front and rear, forming a cut-out in the topside. The groove 28 of the illustrated arrangement has a pair of side walls 29A and 29B which are interconnected by a base wall 29C recessed from the topside 19 so as to be spaced inwardly therefrom. The top opening 27A of the interconnection passageway 27 at the topside 19 of the inner bracket is located in the base 29C of the groove.

Turning now to the second outer bracket 14 of the kit shown more clearly in FIGS. 1-2 and 9-14, the outer bracket 14 comprises a base wall 30 locating a mounting aperture 32 through which a fastener, such as a screw, is passed for mounting the outer bracket with its base wall 30 at the surface. Extending from the base wall in a longitudinal direction of the outer bracket is a peripheral wall 34, so that the base wall and the peripheral wall collectively delimit a cavity C for receiving the inner bracket 12 in the mounting position of the kit whereby the fixture is mounted at the surface. The peripheral wall 34 of the illustrated arrangement is square rectangular in transverse cross-sectional shape so as to have a top wall portion 34A, a bottom wall portion 34B, and left and right wall portions 34C and 34D. In other arrangements (not shown), the peripheral wall may be circular in transverse cross-sectional shape.

Should the fastener for mounting the outer bracket 14 at the surface protrude from an interior face 30A of the base wall, there is provided a central pit 36 in the front end 15 of the inner bracket for receiving a head of this fastener so that it does not obstruct location of the inner bracket within the cavity C in the mounting position.

At a free end 38 of the outer bracket peripheral wall 34 is defined a mouth aperture 39 of the outer bracket, which is opposite the base wall 30, that communicates the cavity C with an exterior of the outer bracket in a longitudinal direction thereof. That is, it is through this mouth aperture 39 that the inner bracket is passed when to be located in the cavity C.

Further to the mouth and mounting apertures of the outer bracket, the bracket 14 includes a fastener aperture 42 in the bottom 34B of the peripheral wall, communicating the cavity C with the bracket exterior in a transverse direction of the outer bracket. The fastener aperture 42 is provided for passing a fastener 45 such as a screw from a location exterior to the outer bracket into the cavity C in the transverse direction.

The fastener aperture 42 tapers in diameter from an outside face 46A to an interior face 46B of the peripheral wall so that a head 47 of the fastener 45 can be received in a location between the outside and interior faces 46A, 46B such that an exterior surface of the kit in the mounting position remains uninterrupted when the fastener 45 is received therein, that is the fastener 45 will not project outwardly beyond the exterior surface 46A of the peripheral wall. The fastener aperture 42 at the interior face 46B of the base wall is sized to prevent passage of the head 47 but allow a shaft 48 of the fastener, which is narrower than the head, therethrough. Thus is formed a stop surface for abutting the fastener head 47 and preventing passage of the head into the cavity C that is defined by a sloped circumferential wall 49 extending from the exterior face 46A to the interior face 46B and which defines the fastener aperture 42. In other arrangements (not shown), the stop surface may be defined by the exterior surface 46A of the peripheral wall, in which case the head of the fastener would protrude outwardly therebeyond.

Further to the fastener aperture, there is provided a fastener tip receptacle 50 in diametrically opposite relation to the fastener aperture 42 across the cavity C, which opens into the cavity C so as to be communicated therewith. The receptacle 50 has an open end 52 communicated with the cavity and is closed at its other end 53, with a side wall 55 that is conical in shape so that a diametric width of the receptacle tapers from the open end 52 to the closed end 53. The tip receptacle 50 receives a leading tip 56 of the fastener passing transversely through the cavity. The side wall 55 is impenetrable to the fastener as the outer bracket of the illustrated arrangement is wholly made from stainless steel such that the side wall 55 has a prescribed hardness to resist piercing by the fastener.

It will be appreciated that in the illustrated arrangement the tip receptacle 50 and the fastener aperture 42 are misaligned so as not to be linearly in-line. In the illustrated arrangement this is done by misaligning centers of the tip receptacle and fastener aperture. More specifically, the fastener tip receptacle is offset from a linear alignment with the fastener aperture in the longitudinal direction of the outer bracket away from the mouth aperture 39 and therefore towards the base wall 30. Thus, when the tip 56 of the fastener is received in the tip receptacle 50 as shown more clearly in FIG. 17, the side wall 55, which is impenetrable to the fastener acts to bias or urge the fastener and thereby the inner bracket 12 towards the base wall 30, which is the direction in which the tip receptacle is offset from the fastener aperture.

The outer bracket includes a ridge 58 extending in the longitudinal direction of the bracket 14 along its full length from base wall 30 to the free end 38, which protrudes into the cavity C from the interior surface 46B of the peripheral wall at the top 34A. The ridge therefore has a pair of side walls 61A, 61B depending from the interior surface 46B which are interconnected by a flat peak 61C spaced inwardly from the interior surface 46B towards an opposite side of the cavity C. The fastener tip receptacle 50 is located in the ridge 58, with the open end 52 located in the peak 61C.

In the mounting position of the kit, the opening 27B of the interconnection passageway 27 in the underside 20 of the inner bracket registers with the fastener aperture 42 in the outer bracket so that the fastener 45 which is passed in the transverse direction through the fastener aperture 42 can be received in the interconnection passageway 27. Furthermore, the opening 27A of the interconnection passageway 27 in the topside 19 of the inner bracket is registered with the fastener tip receptacle, such that in the mounting position the fastener aperture 42, the interconnection passageway 27, and the tip receptacle 50 are generally registered each with one another so that each opening is communicated with the next adjacent one such that a threaded fastener 45 can be passed through this series of communicated openings to hold the inner and outer brackets together in the mounting position of the kit. Thus, with the fastener passing through the series of registered openings movement of the inner bracket 12 relative to the outer bracket 14 in a manner which otherwise would cause the brackets to move out of the mounting position is resisted by engagement of the fastener 45 with the outer bracket 14 at multiple locations on the second bracket, that is, in the illustrated arrangement one which is defined by the fastener tip receptacle 50 and the other by the fastener aperture 42.

Furthermore, the offset of the fastener tip receptacle 50 from a linear alignment with the fastener aperture causes the side wall 55 of the tip receptacle to urge the inner bracket 12, indirectly via the fastener 45 passing through same that is in engagement with the side wall 55, in a direction towards the base wall 30 of the outer bracket. Thus, in the illustrated arrangement there is another interaction of the second bracket with the fastener which acts to maintain the kit of brackets in the mounting position.

In passing the threaded fastener 45 through the inner bracket 12, thread(s) of the fastener 45 bite into the wall 27C of the interconnection passageway 27 so as to be embedded in same causing the outer and inner brackets to be brought towards one another at an interface generally indicated at 63, where the fastener aperture 42 is communicated with the interconnection passageway, when the fastener is prevented from further or deeper passage into the series of communicated openings due to butting engagement of the stop surface 49 with the fastener head 47. This urging together of the inner bracket towards the bottom wall portion 34B of the outer bracket is a further interaction by which the kit of inner and outer brackets is maintained in the mounting position.

In the illustrated arrangement, the inner bracket 12 is arranged so that in the mounting position the interconnection passageway 27 is misaligned with the fastener aperture 42 such that the fastener's penetration of the interconnection passageway wall 27C is enhanced. That is, in the illustrated arrangement, an axis AP of the passageway is not in-line with a center of the fastener aperture 42. This misalignment is achieved in the illustrated arrangement by butting engagement of the fixture F with a rim of the mouth aperture 39 at the free end 38 of the outer bracket, which limits how deep the inner bracket is located within the cavity C, causing the interconnection passageway 27 to be located out of linear alignment with the fastener aperture. The misalignment may also enhance the interaction of the side wall 55 of the tip receptacle with the fastener 45 that biases the inner bracket away from the mouth aperture 39 of the outer bracket.

Additionally, in the mounting position of the kit, the groove 28 is mated with the ridge 58 so as to resist rotation of the inner bracket 12 relative to the outer bracket 14 about an axis R which is parallel to the longitudinal direction.

Thus, once each bracket 12 and 14 is attached to the respective one of the fixture F and at the surface S using fasteners 171, 172 and 174 (shown schematically), the fixture is maneuvered so as to locate the inner bracket 12 in the cavity C, which is in fixed location at the surface S, by passing the inner bracket 12 through the mouth aperture 39. The leading front end 15 of the inner bracket has a smaller periphery than that at the sides 17-20 of the inner bracket so as to form between the front leading end and the sides 17-20 a peripheral guide surface formed by inclined surface portions 68A through 68E which eases location of the inner bracket into the outer bracket. The threaded fastener 45 is then inserted through the registered series of openings in the brackets each communicated with the next in the mounting position of the kit, thereby connecting the brackets together and affixing the fixture at the surface.

In the illustrated arrangement, the leading front end 15 of the inner bracket is spaced from the interior face 30A of the base wall of the outer bracket in the mounting position which may provide additional clearance to a protruding fastener head holding the outer bracket 14 at the surface. The clearance space is provided by sizing the inner bracket 12 in a length dimension between leading front end 15 and trailing rear end 16 smaller than a depth of the cavity C between interior face 30A of the base wall and the free end 38 of the outer bracket.

In other arrangements, the inner bracket 12 may be sized in the length dimension to be substantially equal to the depth of the cavity C, such that misalignment of the interconnection passageway 27 and the fastener aperture 42 is provided by locating the axis AP of the passageway at a prescribed distance to the leading front end 15 of the inner bracket that is different than a distance of the center of the fastener aperture from the interior face 30A of the outer bracket's base wall. Typically, this prescribed distance is larger than the distance of the center of the fastener aperture 42 from the interior face 30A.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A kit for mounting a fixture at a surface, comprising:

a first bracket and a second bracket for attaching to the fixture and for fixedly locating at the surface;

the second bracket defining a cavity for receiving the first bracket in a mounting position of the kit, the first bracket being adapted to be substantially received in the cavity of the second bracket, the second bracket having a mouth aperture in an end of the second bracket communicating the cavity with an exterior of the second bracket in a longitudinal direction of the second bracket through which the first bracket can be passed for arranging the kit in the mounting position;

a fastener aperture which is defined in the second bracket communicating the cavity with the exterior of the second bracket in a transverse direction of the second bracket for passing a fastener from a location exterior to the second bracket into the cavity in the transverse direction;

the second bracket including a stop surface in the vicinity of the fastener aperture for abutting a head of the fastener received through the fastener aperture so as to prevent passage of the head into the cavity;

a passageway which is defined in the first bracket and which is open at opposite sides of the first bracket, a first opening of the passageway being alignable with the fastener aperture in the mounting position of the kit to receive the fastener after the fastener is passed through the fastener aperture in the second bracket;

and a fastener tip receptacle defined within the second bracket and opening into the cavity in a manner that is alignable with an opposite second opening of the passageway in the mounting position of the kit to receive a leading tip of the fastener that is passed through the passageway of the first bracket, such that in the mounting position the fastener engages the second bracket at more than one location on the second bracket including at the stop surface and at the fastener tip receptacle.

2. The kit according to claim 1 wherein the fastener tip receptacle is not linearly aligned with the fastener aperture so that a wall of the tip receptacle acts to bias the fastener in a direction in which the fastener tip receptacle is offset from the fastener aperture.

3. The kit according to claim 2 wherein the fastener tip receptacle is offset in the longitudinal direction of the second bracket away from the mouth aperture.

4. The kit according to claim 2 wherein the wall of the fastener tip receptacle has a prescribed hardness so as to be impenetrable to the fastener.

5. The kit according to claim 1 wherein a wall of the passageway in the first bracket has a prescribed softness so as to be penetrable by the fastener.

6. The kit according to claim 1 wherein the first bracket includes a longitudinally extending groove and the second bracket includes a ridge extending in the longitudinal direction and protruding into the cavity for mating with the groove.

7. The kit according to claim 6 wherein the fastener tip receptacle is formed in the ridge and the passageway in the first bracket opens at the groove.

8. The kit according to claim 1 wherein the fastener aperture decreases in diameter from an outside of the bracket towards the cavity such that the stop surface is defined by a wall defining the fastener aperture.

9. The kit according to claim 1 wherein the fastener tip receptacle is conical in shape.

10. The kit according to claim 1 wherein the first bracket is arranged so that the passageway is misaligned with the fastener aperture in the mounting position of the kit.

* * * * *